US005803353A

United States Patent [19]

Fisher

[11] Patent Number: 5,803,353

[45] Date of Patent: Sep. 8, 1998

[54] DEFLECTABLE MAILBOX ASSEMBLY

[76] Inventor: James P. Fisher, 19913 Rosin, Clinton Township, Mich. 48038

[21] Appl. No.: 616,058

[22] Filed: Mar. 14, 1996

[51] Int. Cl.[6] ..... B65D 91/00

[52] U.S. Cl. ..... 232/39; D99/32

[58] Field of Search ..... D99/32; 232/39; 404/6, 9; 248/900, 548, 417, 156; 40/606, 608; 256/1, 19

[56] References Cited

U.S. PATENT DOCUMENTS

| | | | |
|---|---|---|---|
| 1,370,697 | 3/1921 | Mann . | |
| 1,402,465 | 1/1922 | Wood . | |
| 1,599,066 | 9/1926 | Rushmore . | |
| 1,726,817 | 9/1929 | Franklin . | |
| 1,866,982 | 7/1932 | Michener . | |
| 1,903,869 | 4/1933 | Meister et al. . | |
| 1,939,968 | 12/1933 | Frei, Jr. | 189/23 |
| 2,165,704 | 7/1939 | Hood | 40/145 |
| 2,684,822 | 7/1954 | Odin | 248/179 |
| 3,080,149 | 3/1963 | Pilboue | 256/19 X |
| 4,090,465 | 5/1978 | Bell, Sr. | 116/63 R |
| 4,187,978 | 2/1980 | Dowker | 232/39 |
| 4,367,844 | 1/1983 | Drummond | 232/17 |
| 4,373,464 | 2/1983 | Blau | 116/63 R |
| 4,486,117 | 12/1984 | Blau | 404/10 |
| 4,535,974 | 8/1985 | Conde | 256/1 |
| 4,599,012 | 7/1986 | Kugler et al. | 404/10 |
| 5,022,618 | 6/1991 | Barrett et al. | 232/39 X |
| 5,119,986 | 6/1992 | Kobilarcik et al. | 232/35 |
| 5,207,377 | 5/1993 | Brecht | 232/17 |
| 5,284,326 | 2/1994 | Chiovitti et al. | 256/13.1 |
| 5,307,598 | 5/1994 | West | 52/155 |
| 5,337,953 | 8/1994 | Haest | 232/17 |
| 5,357,897 | 10/1994 | Bailey | 116/209 |
| 5,435,483 | 7/1995 | Cox | 232/38 |

FOREIGN PATENT DOCUMENTS

| | | |
|---|---|---|
| 1552818 | 12/1968 | Italy . |
| 940775 | 10/1960 | United Kingdom . |

*Primary Examiner*—Jerry Redman
*Attorney, Agent, or Firm*—Harness, Dickey & Pierce, P.L.C.

[57] ABSTRACT

A mailbox assembly is provided which includes a resiliently deflectable support structure and an upper mailbox portion. The resiliently deflectable support structure is preferably unitarily formed to include an generally vertical support member and a generally horizontal support member. The generally vertical support member and the generally horizontal support member are similarly constructed to include a rubber outer skin and a longitudinally extending coil spring.

20 Claims, 3 Drawing Sheets

DEFLECTABLE MAILBOX ASSEMBLY

BACKGROUND OF THE INVENTION

1. Field of the Invention

The present invention generally relates a receptacle for mail, newspapers and the like. More particularly, the present invention relates to a mailbox assembly which includes a deflectable vertical support member and preferably also includes a deflectable horizontal support.

2. Description of the Prior Art

It is often desirable to locate mailbox structures adjacent to the front boundary of residential or commercial property. While such a location positions a mailbox structure in close proximity to the road to facilitate delivery of mail and newspapers by motor carrier, it also renders a mailbox structure susceptible to both intentional damage and accidental damage. As a result, expensive and time consuming repairs or even replacement are often necessitated.

In instances of intentional damage, roadside mailbox structures are frequently the target of random vandalism due to their direct accessibility by motor vehicle. Accidental damage frequently results from careless driving habits and may also be attributable to severe weather conditions. In this regard, severe weather conditions such as rainstorms, snow, and fog contribute to poor visibility and longer braking distances. As a result, the integrity and life span of conventional roadside mailbox structures is threatened.

In addition to damage to the mailbox structure, a vehicle that collides with a conventional mailbox structure is also typically subjected to damage. For example, a mail delivery vehicle or other vehicle skidding or sliding into an unyielding mailbox structure can be scratched, dented or otherwise seriously damaged. Moreover, the occupant inside the vehicle may also be injured depending on the rate of speed with which the vehicle encounters the mailbox structure. Accidentally colliding with a conventional mailbox structure may also fracture the vertical support member, thereby potentially causing the contents of the mailbox to spill onto the ground and become damaged or destroyed.

Furthermore, conventional mailbox structures are also frequently the source of injury to pedestrian and bicyclists. Typically, such injuries are incurred by children that unknowingly encounter a mailbox structure while running on foot or riding a bicycle. These injuries occur due to the rigid, non-yielding nature of conventional mailboxes.

Given the total number of roadside mailboxes in existence, both urban and rural, coupled with the above discussed potential for vandalism and accidents, the costs for repair and replacement of mailboxes are considerable. In addition, the above discussed accidents involving conventional mailbox structures can be blamed for higher mail carrier insurance and significant avoidable vehicle damage. Thus, a long felt need exists for a mailbox structure which is less suspectable to damage and less likely to damage an encountering vehicle.

Heretofore, various attempts have been made in the prior art to provide a more durable and/or damage resistant mailbox structure. For example, U.S. Pat. No. 5,207,377 to Brecht discloses a mailbox structure including a lower mailbox portion, an upper mailbox portion and a mounting pipe for securing the mailbox into the ground. A laterally deformable lower bellows member is integrally attached to the mailbox structure subjacent the lower mailbox portion. The lower bellows member allows the mailbox structure to laterally deflect from its normal upright position when the mailbox is struck by a physical object, such as a vehicle.

The structure taught by Brecht, while effective for deflectable supporting a postal material receiving portion, is complicated and expensive to manufacture. Additionally, the bellows member located adjacent the ground is unconventional in appearance and as a result does not appeal to a large segment of the mailbox purchasing market. Furthermore, the vertical support taught by Brecht is not deflectable along a substantial portion of its length, nor is the vertical support equally deflectable in all horizontal directions.

In addition to the teachings of Brecht, a number of resiliently deflectable support posts are known. Examples of such support posts are shown in U.S. Pat. Nos. 1,599,066 and 2,165,704 directed to signs; U.S. Pat. No. 4,090,465 directed to a traffic control director; U.S. Pat. No. 4,486,117 directed to a flexible traffic standard; U.S. Pat. No. 4,535,974 directed to an impact absorbing parking space barrier and U.S. Pat. No. 5,357,897 directed to a golf course distance marker.

While prior known devices, including but not limited to those discussed above, have proven to be commercially acceptable for a wide range of applications, each is attendant with its drawbacks and inherent limitations. As noted above, some prior known devices are complicated in construction and/or associated with increased manufacturing costs. Other known devices are unable to rigidly support the weight of a mail receptacle portion in a functional manner. Still other known devices are difficult to install. Still yet other known devices are not deflectable along a substantial portion of their vertical length. Thus, there unquestionably remains a need in the art for a simple, inexpensive apparatus for delectably supporting a mailbox structure.

SUMMARY OF THE INVENTION

The present invention is directed to an apparatus which overcome the drawbacks of prior known devices, including those discussed above. In one preferred form, the apparatus of the present invention comprises a resiliently deflectable support structure for an upper mailbox portion. The upper mailbox portion is of the type defining an inner storage compartment and having a mailbox opening which allows material to be passed therethrough for depositing into the inner storage compartment. The resiliently deflectable support structure includes a generally vertical support member including a flexible outer member surrounding a resilient inner member. The resiliently deflectable support structure further includes a generally horizontal support member interconnected to the generally vertical support member. The generally horizontal support member is attached to the upper mailbox portion. In use, the generally vertical support member is resiliently deflectable from a substantially vertical orientation.

In another preferred form, the apparatus of the present invention comprises a mailbox assembly including an upper mailbox portion defining an inner storage compartment and having a mailbox opening which allows material to be passed therethrough for depositing into the inner storage compartment thereof. The mailbox assembly further includes a support structure having a generally vertical support member with a first end enlarged for securing the mailbox into the ground. The upper mailbox portion is attached to the support structure. The generally vertical support member is resiliently deflectable along a substantial portion of its length.

In yet another form, the apparatus of the present invention comprises a mailbox assembly including a support structure having a generally vertical support member and a generally horizontal support member. Each of the generally vertical and generally horizontal support members being resiliently deflectable along a substantial portion of their respective lengths.

BRIEF DESCRIPTION OF THE DRAWINGS

Further objects, features and advantages of the present invention will become apparent from analysis of the following written specification and accompanying drawings and the appended claims in which:

DETAILED DESCRIPTION OF THE PREFERRED EMBODIMENTS

Figure 1:
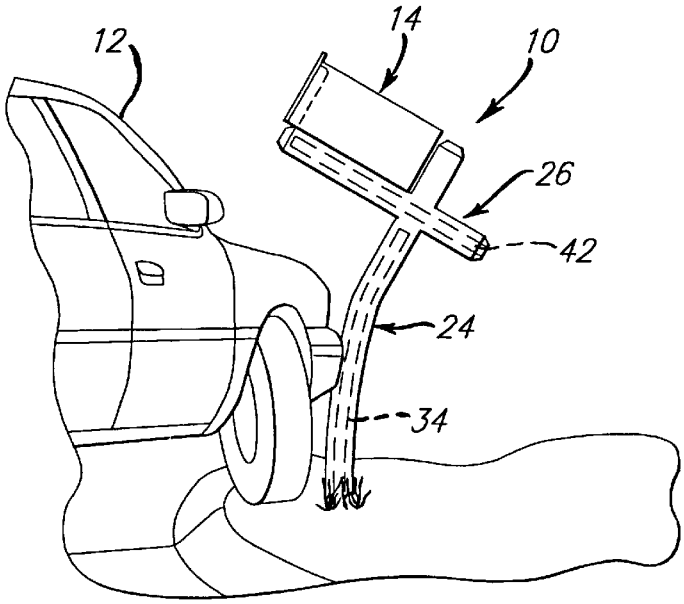
FIG. 1 is an environmental view partially illustrating an automobile engaged with a mailbox assembly constructed in accordance with a preferred embodiment of the present invention and showing the vertical support member of the mailbox assembly deflected as a result of impact from the vehicle.

As required, detailed embodiments of the present invention are disclosed herein. However, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Turning generally to FIGS. 1 through 6 of the drawings in which identical or equivalent elements have been denoted with like reference numerals, a first preferred embodiment of the present invention is illustrated. With specific reference to FIG. 1, an environmental view is illustrated in which a deflectable mailbox assembly constructed in accordance with the first preferred embodiment is identified generally at 10. The mailbox assembly 10 is shown deflected under the force of vehicle 12 which has inadvertently encountered the mailbox assembly 10. Following the remainder of this detailed description, it will become apparent that the mailbox assembly 10 will return to a generally upright position as soon as the vehicle 12 is displaced therefrom.

In the exemplary embodiment illustrated in FIGS. 1 through 6, the mailbox assembly 10 is shown to include an upper mailbox portion 14 and a support structure 16. As shown in the cross-sectional view of FIG. 6, the upper mailbox portion 14 includes a housing 15 which defines an inner storage compartment 18 and includes a mailbox opening which allows material such as mail, newspapers and the like to be passed therethrough for deposit into the inner storage compartment 18. Further, in a conventional manner, the upper mailbox portion 14 includes a door pivotally mounted to the housing 15. In a preferred embodiment, the upper mailbox portion 14 is constructed of rubber, or other resilient material such as plastic and the like. The upper mailbox portion 14 further includes an inner steel belt 22. While not preferred, it will be understood that the upper mailbox portion 14 may alternatively be constructed from non-resilient material such as metal.

Figure 2:
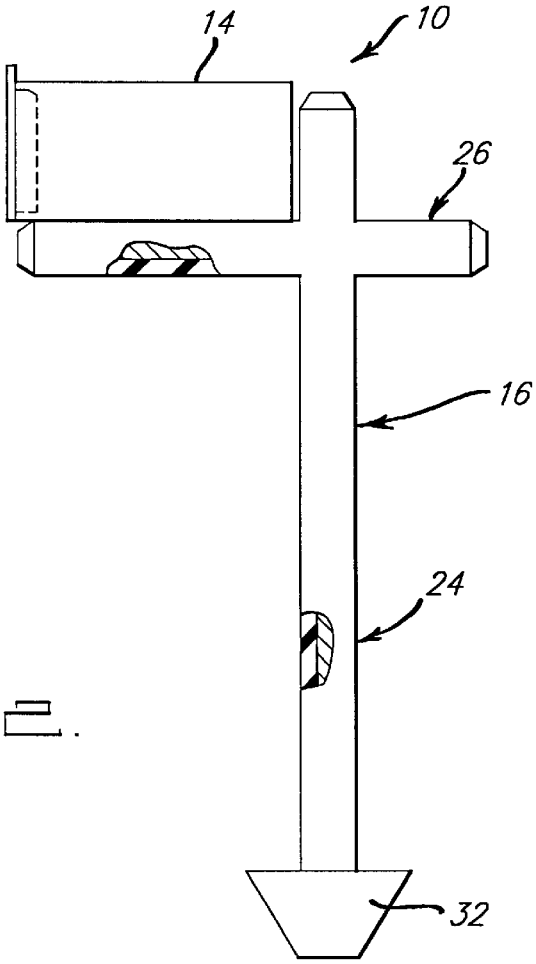
FIG. 2 is an enlarged partial cut-away view side of the mailbox assembly of FIG. 1.
Figure 3:
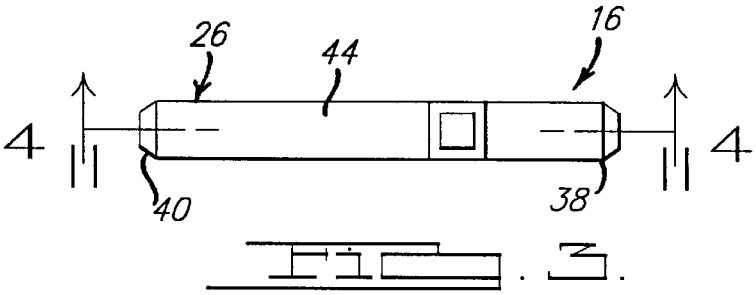
FIG. 3 is a top view of the mailbox assembly of FIG. 2 illustrated with the mail receptacle portion of the mailbox assembly removed for purposes of illustration.
Figure 4:
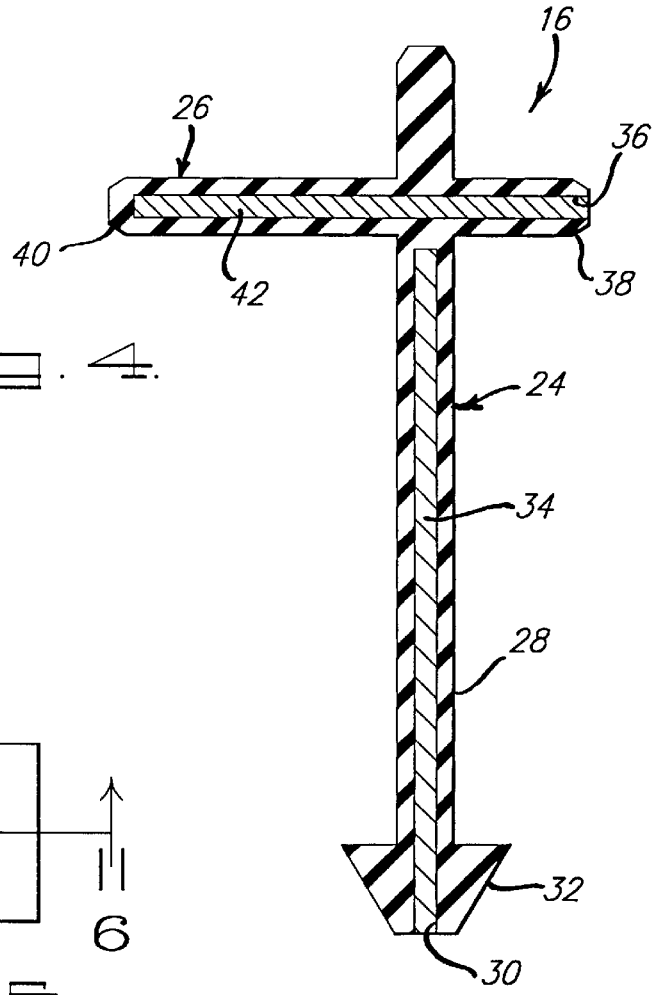
FIG. 4 is a cross-sectional view taken through the line 4—4 of FIG. 3.
Figure 5:
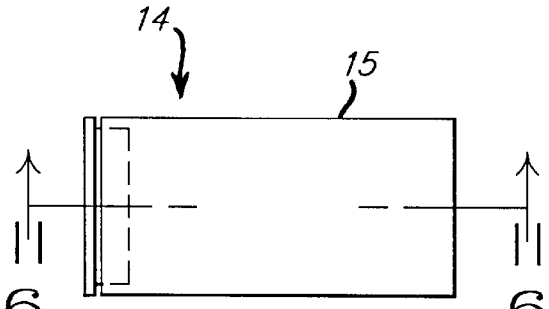
FIG. 5 is a top view of the mail receptacle portion of FIG. 2.
Figure 6:
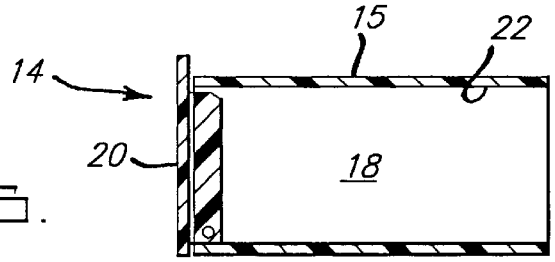
FIG. 6 is a cross-sectional view taken along the line 6—6 of FIG. 5.

With specific reference to FIGS. 2 through 4, the support structure 16 of the mailbox assembly 10 of the preferred embodiment of the present invention is shown to be unitarily constructed to include a generally vertical support member 24 and a generally horizontal support member 26. In the embodiment illustrated, the support structure 16 is conventional in appearance and is intended to aesthetically represent a construction from timbers such as four inch by four inch (4×4) posts or the like. To further facilitate the genuine exterior appearance of the support structure 16, it will be understood that the exterior of the support structure 16 can be paintable or may alternatively include a wood grain finish.

The vertical support member 24 has a generally rectangular construction and is formed to include a rubber outer skin 28. The rubber outer skin 28 includes a centrally located, longitudinally extending channel 30 which is open adjacent a first end 32 of the vertical support member 24. At an upper end, the longitudinal channel terminates subjacent the intersection of the vertical support member 24 and the horizontal support member 26. In one application, the vertical support member 24 is between four feet and five feet in length and has nominal cross-sectional dimensions of approximately four inches by four inches.

In the exemplary embodiment illustrated, the first end or lower end 32 of the vertical support member 24 includes an enlarged cross-section to facilitate mounting within the ground. More specifically, the first end 32 is frustoconical in shape, having an exterior surface which tapers downwardly. In use, the frustoconical first end 32 of the vertical support member 24 is completely buried beneath the surface of the ground (as shown in FIG. 1). Given the inherent resiliency of the vertical support member 24, as will be discussed below, in many applications burial of the frustoconical first end 32 will be sufficient to support the mailbox assembly 10. However, depending upon soil condition and other factors such as the size of the mailbox assembly 10 and upper mailbox portion 14, the first end 32 of the vertical support member 24 may also need to be additionally secured within the ground with cement or other known techniques.

The support structure 16 further includes a first or vertical coil spring 34 disposed within the longitudinal channel 30. The first or vertical coil spring 34 extends a substantial portion of the vertical support member 24. In the preferred embodiment illustrated in FIGS. 1 through 6, the first or vertical coil spring 34 has a uniform cross-section. As a result, the vertical support member 24 is equally deflectable along a substantial portion of its length. In one application, the first or vertical coil spring 34 has a diameter of approximately between one inch and two inches. The construction of the vertical support member 24 permits it to be deflected in any horizontal direction.

Similar to the construction of the vertical support member 24, the horizontal support member 26 is generally rectangular in cross-section and is formed to include a longitudinally extending channel 36 centrally therein. In the embodiment illustrated, the longitudinal channel 36 is opened adjacent a first end or rear end 38 of the horizontal support member 26 and terminates forwardly adjacent a second end or front end 40 of the horizontal support member 26. Further similarly, a second or horizontal coil spring 42 is disposed within the longitudinal channel 36 along a substantial portion of the horizontal support member 26. Again, the second or horizontal coil spring 42 includes a generally uniform diameter of approximately between 1 inch and 2 inch. The construction of the horizontal support 26 permits it to be deflected within a horizontal plane, a vertical plane, or both.

The rectangular cross-section of the horizontal support member 26 defines an upper planar surface 44 for directly supporting the upper mailbox portion 14. While not specifically illustrated, it will be appreciated by those skilled in the art that the upper mailbox portion 14 of the mailbox assembly 10 is suitably attached to the upper planar surface 44 of the horizontal support member 26 in any suitable manner well known in the art. For example, the upper mailbox portion 14 can be screwed, bolted or otherwise fastened to the upper planar portion 44 of the horizontal support member 26. Alternatively, the upper mailbox portion 14 can be unitarily formed with the support structure 16.

Figure 7:
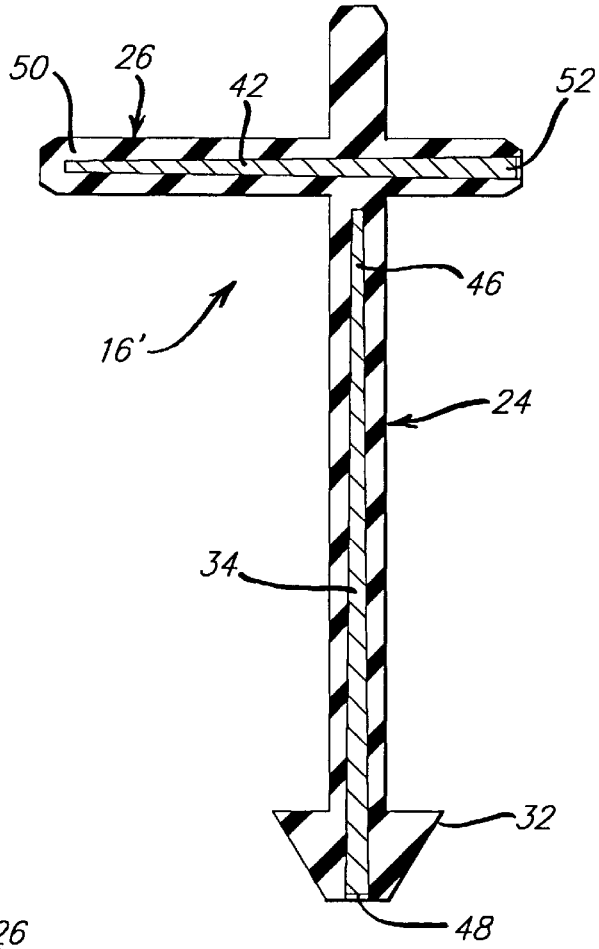
FIG. 7 is a cross-sectional view similar to FIG. 4, illustrating a mailbox assembly constructed in accordance with a second preferred embodiment of the present invention.
Figure 8:
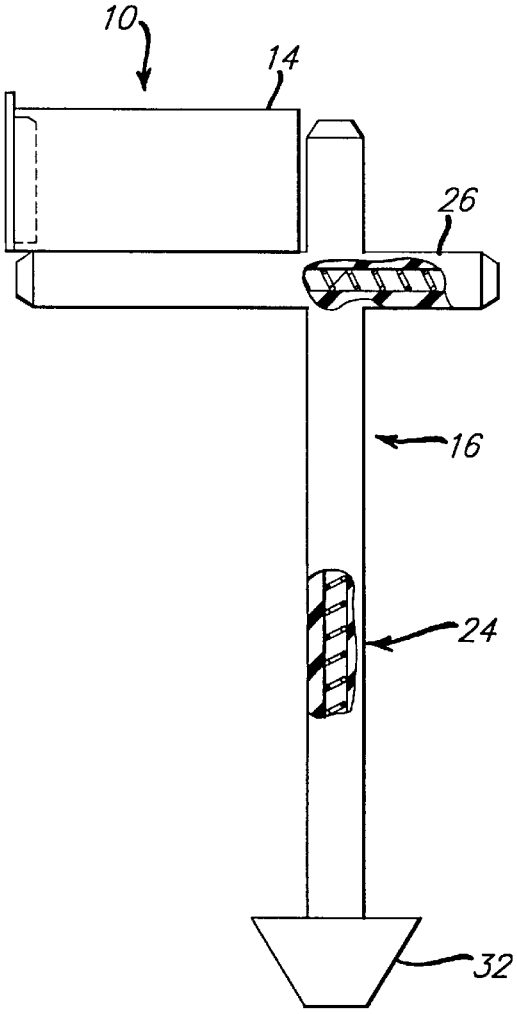
FIG. 8 is an enlarge partial cut way view of the mailbox assembly of FIG. 1 constructed in accordance with a second preferred embodiment of the present invention.

With reference to FIG. 7, a support structure 16' constructed in accordance with the teachings of a second preferred embodiment of the present invention is illustrated. The support structure 16' includes various elements substantially similar to those described in connection with the first preferred embodiment shown in FIGS. 1 through 6. As a result, common reference numerals are used in FIG. 7 to designate identical or equivalent elements.

The support structure 16' departs from the first preferred embodiment in that the first or vertical and second or horizontal coil springs 34 and 42 do not include an uniform diameter. In the embodiment illustrated, the first or vertical coil spring 34 has a first end or upper end 46 including a diameter significantly smaller than a second end or lower end 48. Similarly, the second or horizontal coil spring 42 has a first end 50 having a diameter that is significantly smaller than a second end or rear end 52. By varying the diameter of the coil springs 34 and 42, the amount of applied force necessary to deflect the respective support member 24 or 26 is correspondingly varied along its length.

In construction, the rubber outer skin 28 of the support structure 16 is unitarily formed with a mold (not shown). The longitudinal channels 30 and 36 may be formed with plugs used during the molding process or alternatively bored subsequent to the molding process. The first or vertical and second or horizontal coil springs 34 and 42 are inserted within the longitudinal channel 30 and 36. In the preferred embodiments illustrated, the first or vertical and second or horizontal coil springs 34 and 42 are retained within their respective longitudinal channels 30 and 36 through an interference fit. Alternatively, the coil springs 34 and 42 may be also retained through additional mechanical means. For example, the open ends of the channel 30 and 36 may include a cap (not shown) or multiple fastener may pass through the rubber outer skin 28 so as to engage the coil springs 34 and 36.

In use, the mailbox assembly 10 of the first and second preferred embodiments of the present invention is intended to withstand being run over by a vehicle 12 without significant damage. The natural resiliency of the rubber outer skin 28 and the coil springs 34 and 42 permit the support structure 16 or 16' to be significantly deflected and subsequently returned to its original position once the external force is removed. Additionally, the construction of the upper mailbox portion 14 is intended to withstand damage from vandalism or vehicle collision.

While the above description constitutes two preferred embodiment of the invention, it will be appreciated that the invention is susceptible to modification, variation, and change without departing from the proper scope or fair meaning of the accompanying claims. For example, the preferred embodiments shown in the drawings include support structures 16 and 16' which are specifically intended to support a single upper mailbox portion 14. Alternatively, the horizontal support 26 can rotate 90° within a horizontal plane and elongate so as to facilitate mounting of multiple upper mailbox portions 14.

I claim:

1. A resiliently deflectable support structure in combination with an upper mailbox portion having an inner storage compartment and having a mailbox opening which allows material to be passed therethrough for depositing into the inner storage compartment, the resiliently deflectable support structure comprising:

a generally vertical support member including a flexible outer portion surrounding a resilient inner member, said inner member being a first coil spring; and a generally horizontal support member interconnected to said generally vertical support member, said generally horizontal support member being attached to the upper mailbox portion, wherein said generally horizontal support member includes a second coil spring;

whereby said generally vertical support member is resiliently deflectable from a substantially vertical orientation.

2. The resiliently deflectable support structure of claim 1 wherein said outer portion being constructed of rubber.

3. The resiliently deflectable support structure of claim 1, wherein said first coil spring has a uniform diameter.

4. The resiliently deflectable support structure of claim 1, wherein said generally vertical support member being resiliently deflectable along a substantial portion of its length.

5. The resiliently deflectable support structure of claim 1, wherein said first coil spring has a first end having a first diameter and a second end having a second diameter, said first diameter being larger than said second diameter.

6. A resiliently deflectable support structure for an upper mailbox portion defining an inner storage compartment and having a mailbox opening which allows material to be passed therethrough for depositing into the inner storage compartment, the resiliently deflectable support structure comprising:

a generally vertical support member including a flexible outer portion surrounding a resilient inner member, said inner member being a vertical coil spring; and a generally horizontal support member interconnected to said generally vertical support member, said generally horizontal support member being attachable to the upper mailbox portion, wherein said generally horizontal support member includes a horizontal coil spring;

whereby said generally vertical support member is resiliently deflectable from a substantially vertical orientation.

7. The resiliently deflectable support structure of claim 6, wherein said outer portion is constructed of rubber.

8. The resiliently deflectable support structure of claim 6, wherein said horizontal coil spring has a uniform diameter.

9. The resiliently deflectable support structure of claim 6, wherein said generally horizontal support member being resiliently deflectable from a substantially horizontal orientation.

10. The resiliently deflectable support structure of claim 6, wherein said horizontal coil spring has a first end having a first diameter and a second end having a second diameter, said first diameter being larger than said second diameter.

11. The resiliently deflectable support structure of claim 6, wherein said vertical coil spring has a first end having a first diameter and a second end having a second diameter, said first diameter being larger than said second diameter.

12. The resiliently deflectable support structure of claim 11, wherein said vertical coil spring has a uniform diameter.

13. The resiliently deflectable support structure of claim 11, wherein said generally vertical support member is resiliently deflectable from a substantially vertical orientation along a substantial portion of its length.

14. The resiliently deflectable support structure of claim 11, wherein said vertical coil spring has a first end having a first diameter and a second end having a second diameter, said first diameter being larger than said second diameter.

15. A resiliently deflectable support structure for an upper mailbox portion defining an inner storage compartment and having a mailbox opening which allows material to be passed therethrough for depositing into the inner storage compartment, the resiliently deflectable support structure comprising:

a generally vertical support member including a flexible outer portion surrounding a resilient inner member wherein said generally vertical support member being a vertical coil spring;

said generally vertical support member having a first end adapted to be buried into the ground; and a generally horizontal support member comprising a coil spring and interconnected to said vertical support member;

whereby said generally vertical support member is resiliently deflectable from a substantially vertical orientation.

16. The resiliently deflectable support structure of claim 15, wherein said first end is enlarged relative to said generally vertical support member.

17. The resiliently deflectable support structure of claim 15, wherein said first end being frustoconical in shape.

18. The resiliently deflectable support structure of claim 15, wherein said generally vertical support member being resiliently deflectable along a substantial portion of its length.

19. The resiliently deflectable support structure of claim 18, wherein said outer portion being constructed of rubber.

20. The resiliently deflectable support structure of claim 15, wherein said vertical coil spring has a uniform diameter.

* * * * *